US005956878A

United States Patent [19]

Yang

[11] Patent Number: 5,956,878

[45] **Date of Patent: *Sep. 28, 1999**

[54] CARTRIDGE MAGAZINE FOR A FIREARM

[75] Inventor: Hyung Tae Yang, Busan, Rep. of Korea

[73] Assignee: Agency for Defense Development, Daejon, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/906,170

[22] Filed: Aug. 5, 1997

[30] Foreign Application Priority Data

Aug. 7, 1996 [KR] Rep. of Korea ..... 96-32897

[51] Int. Cl.[6] ..... F41A 9/61

[52] U.S. Cl. ..... 42/50; 42/6; 42/18

[58] Field of Search ..... 42/50, 6, 18

[56] References Cited

U.S. PATENT DOCUMENTS

| | | | |
|---|---|---|---|
| 885,868 | 4/1908 | Savage | 42/50 |
| 947,481 | 1/1910 | Consentino | 42/50 |
| 999,387 | 8/1911 | Mauser | 42/50 |
| 1,245,499 | 11/1917 | Orme | 42/50 |
| 1,323,063 | 11/1919 | Johnson | 42/50 |
| 1,350,619 | 8/1920 | Payne | 42/50 |
| 1,358,105 | 11/1920 | Payne | 42/50 |
| 1,407,633 | 2/1922 | Burton | 42/50 |
| 2,205,967 | 6/1940 | Wise | 42/50 |
| 2,429,831 | 10/1947 | Lippert et al. | 42/50 |
| 3,383,790 | 5/1968 | Into | 42/50 |
| 3,577,860 | 5/1971 | Jestrabek | 42/50 |
| 4,139,959 | 2/1979 | Howard et al. | 42/50 |
| 5,113,605 | 5/1992 | Kim | 42/50 |
| 5,495,687 | 3/1996 | Waiser | 42/50 |

*Primary Examiner*—Charles T. Jordan
*Assistant Examiner*—Meena Chelliah
*Attorney, Agent, or Firm*—Nikaido, Marmelstein, Murray & Oram LLP

[57] ABSTRACT

A cartridge magazine for a firearm comprises a case having a guiding extrusion extending downwardly along at least one wall therein selected from a front wall and a rear wall, a bullet support provided inside the case so as to move up and down and including another guiding extrusion to be movably inserted in the guiding extrusion at a portion selected from a front and a rear portion thereof and having a balance protrusion at another portion thereof, and a spring for elastically and constantly supporting the bullet supporting means. The cartridge serves to smoothly send bullets loaded therein toward a powder chamber of a firearm while maintaining a horizontal level of the bullet support.

6 Claims, 4 Drawing Sheets

CARTRIDGE MAGAZINE FOR A FIREARM

BACKGROUND OF THE INVENTION

1. Field of the Invention

The present invention relates to a cartridge, magazine more particularly to a cartridge magazine for a firearm for smoothly sending bullets loaded therein into a powder chamber of the firearm while maintaining a horizontal level of the loaded bullets.

2. Description of Prior Art

To conventional military firearms such as M16 and Kn (n=1, 1A, 2, 3 . . . ) series rifles there is applied a cartridge magazine for consecutively and sequentially relaying bullets into a powder chamber. Under the cartridge magazine mechanism, a dent provided in a lower portion of a firearm body and communicating with the powder chamber receives a bullet cartridge loaded with a plurality of bullets such as a 20-bullet set or a 30-bullet set and relays one at a time of the loaded bullets into the powder chamber the moment a barrel end is pulled back and released.

Reference numeral 1 in FIGS. 1 and 2 denotes a conventional cartridge magazine for a firearm, wherein the cartridge magazine 1 includes: a case 2 for receiving bullets and having an open top and closed bottom; a bullet support 3 inserted in the case to move up and down to immediately send a bullet B to a powder chamber of the firearm; and a spring 4 for elastically and upwardly supporting the bullet support 3.

The case 2 is formed to have a top portion thereof open and a bottom thereof closed, wherein each of the side plates and the bottom plate is formed by a plating technique such as a spot welding. An opening 2' is formed to initially receive and prevent from being randomly sprung out therefrom an incoming bullet, wherein a bullet is elastically sent forward the moment a controlling iron is pulled back and released.

A front wall 2*a* of the case 2 is formed to be horizontally flat. Along the center line of a rear wall 2*b* there is formed a guiding depression 2*c*. In a front portion of the bullet support 3 there are formed a pair of extrusions 3*a* each of which abuts the inner side of the front wall 2*a* of the case 2. In a rear portion of the bullet support 3 there is formed a guiding extrusion 3*b* moving along the guiding depression 2*c*.

Extending from a backwardly eccentric center of a lower surface of the bullet support 3 is a protrusion 3*c* having a recess 3*d* punched therein from the front surface of the bullet support 3, into which recess 3*d* is inserted a static pin 4*a* bent extending from an upper portion of the spring 4.

A lower end of the spring 4 is contacted to and supported by the bottom plate of the case 2 and an upper end thereof serving as the static pin 4*a* is inserted into the recess 3*d* thus to constantly push up the bullet support 3.

In the such a conventional cartridge magazine for a firearm, the bullet support 3 is initially positioned at the top of the opening 2' of the case 2. When a bullet is mounted on the bullet support 3 through the opening 2' and downwardly pushed, the force charged on the bullet support 3 while pushing in the bullet excels the elasticity of the spring 4, whereby the bullet is loaded into the case 2.

During continuous loading of bullets into the case 2, the bullets are sequentially arranged in zigzag while maintaining a horizontal level of the bullets B, and a top bullet is hooked in the opening 2' at the upper portion of the case 2 to thereby prevent the bullet(s) from being seceded.

That is, when a cartridge magazine loaded with bullets B is inserted into a firearm, and a controlling iron is pulled back and released according to a gas pressure occurring during a gunshot, the bullet positioned at the top in the case 2 is elastically sent into the powder chamber. Then, the bullet is forwarded through the barrel of the firearm over to a target.

However, the conventional cartridge magazine has a disadvantage in that the front and rear portion of the bullet support 3 for being contacted to the corresponding front and rear wall of the case 2 is so small and accordingly the restraining force to enable the bullet support 3 to remain horizontal is so weak that the bullet support 3 as shown in FIGS. 3A and 3B easily tilts back and forth when bullets are being mounted or during a gunshot.

When the bullet support 3 undesirably tilts, the bullets B sequentially stacked thereon do not maintain a horizontal level so that the front or rear portion of each of the bullets B becomes exposed above the opening 2'. As a result, when the controlling iron is pulled back and released to send a bullet into the powder chamber, there may occur a malfunction such as an unsending, a double sending and an unreceiving of a bullet.

Further, when the bullet B is tiltingly loaded into the case 2, and the controlling iron functions in accordance with the force of a bumper spring provided in the firearm, internal parts of the firearm as well as bullets may lead to unwanted damage, thereby incurring a military budget waste.

Still further, the above-described malfunctioning of the firearm resulting from the cartridge magazine may generate a psychological disorder to combat forces dealing with those firearms, which can in turn cause a lowered military morale and loss of combat forces. Those disadvantages are critical especially to a crooked cartridge magazine as shown in the accompanying drawings, wherein the lower part of the cartridge magazine is forward bent.

SUMMARY OF THE INVENTION

Therefore, it is an object of the present invention to provide a cartridge magazine for a firearm which prevents the tilting of bullets loaded therein to maintain a horizontal level, whereby a malfunction such as an unsending, a double sending or unreceiving of the bullet or bullets can be remarkably improved.

It is another object of the present invention to maintain an accurate bullet-loading status when especially applied to a crooked cartridge magazine which bullet support has a curved orbit therein due to a forward bent lower portion of the cartridge case.

To achieve the above-described objects, the cartridge magazine for a firearm comprises a case including an opening at an upper portion thereof and a closed plate at a lower portion thereof, and having a guiding member extending downwardly along a wall selected from a front wall and a rear wall, a follower provided inside the case to move up and down, including another guiding member to be movably inserted in the guiding member at a portion selected from a front and a rear portion thereof and having a balance protrusion at another portion thereof, and a spring for elastically and constantly supporting the follower.

DETAILED DESCRIPTION OF THE PRESENT INVENTION

Figure 1:
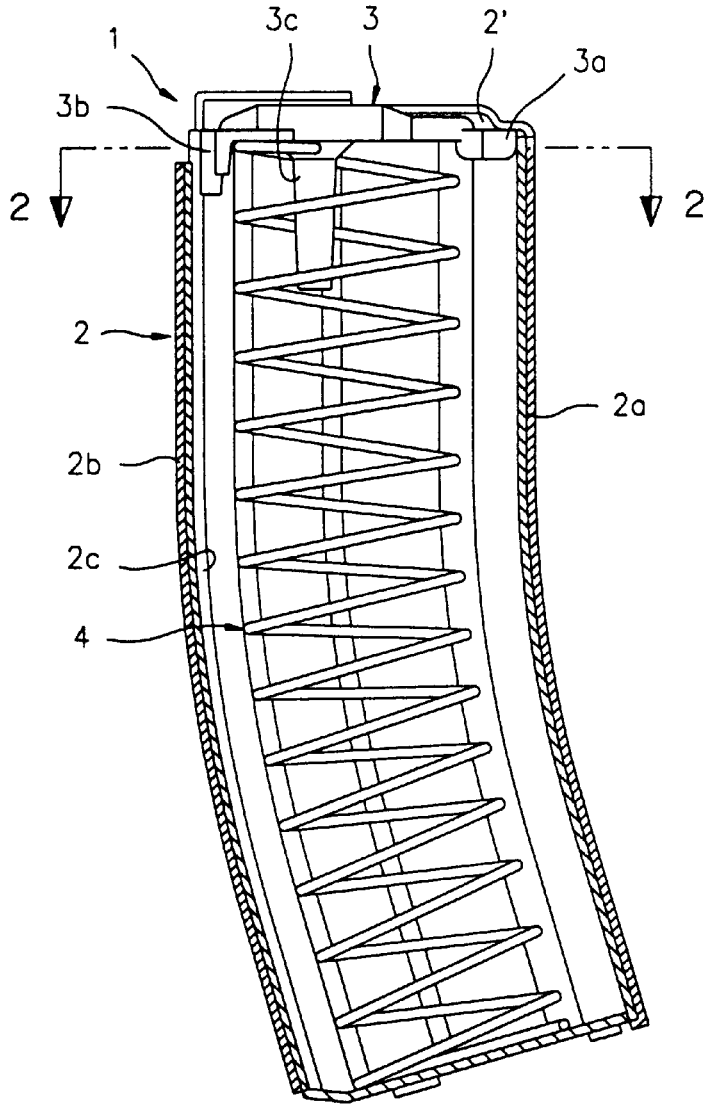
FIG. 1 CONVENTIONAL ART
FIG. 1 is a cross-sectional side view of a conventional bullet cartridge for a firearm.
Figure 2:
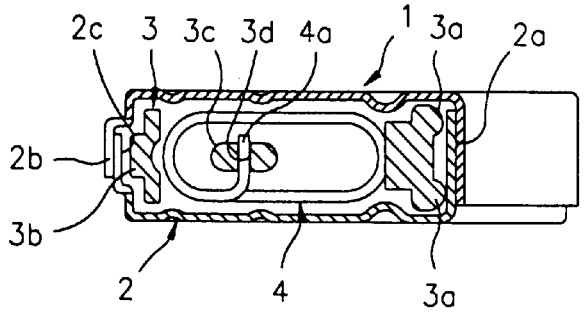
FIG. 2 CONVENTIONAL ART
FIG. 2 is a cross-sectional view taken along a line A—A in FIG. 1.
Figure 3A:
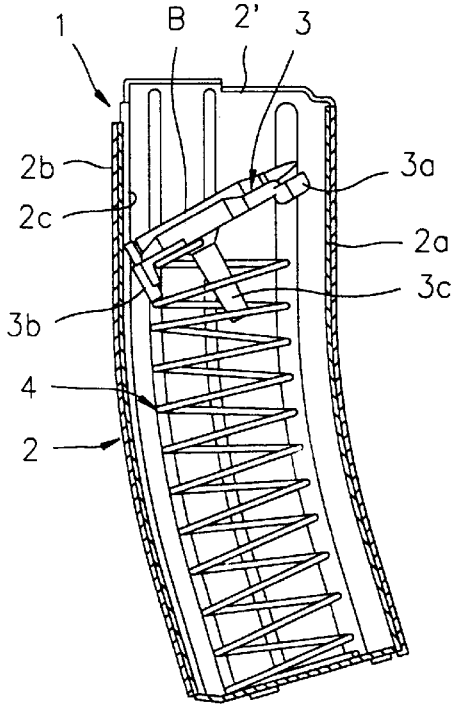
FIG.3A CONVENTIONAL ART
FIGS. 3A and 3B are cross-sectional side views each showing a malfunctioning in the conventional cartridge magazine for a firearm.
Figure 3B:
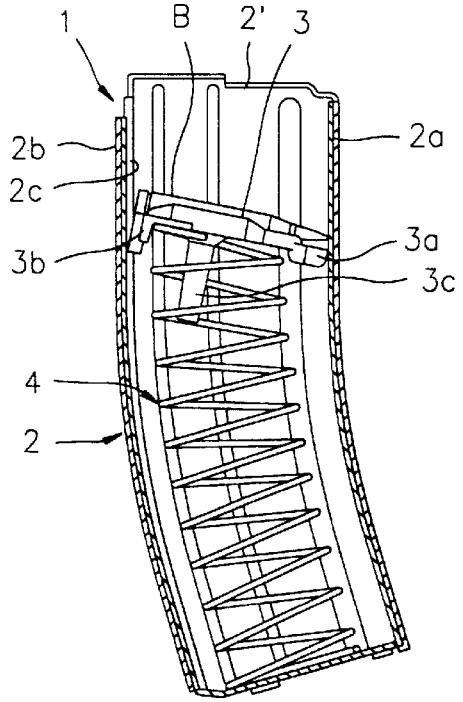
FIG.3B CONVENTIONAL ART
Figure 4:
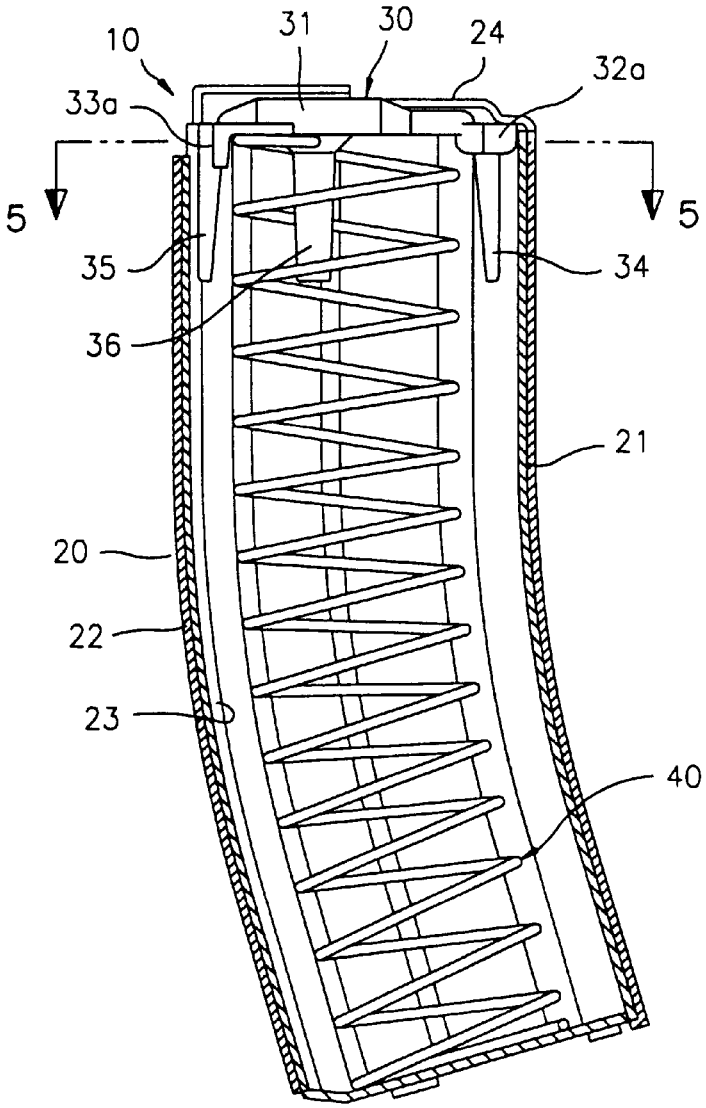
FIG. 4 is a cross-sectional side view of a bullet cartridge for a firearm according to the present invention.
Figure 5:
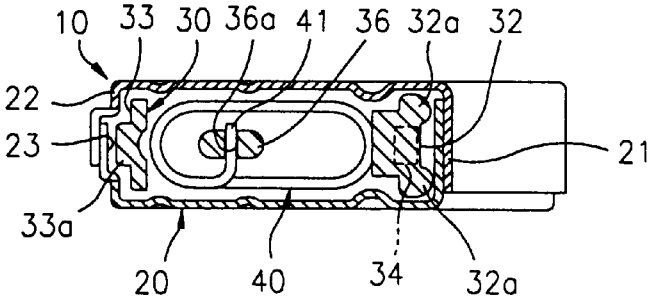
FIG. 5 is a cross-sectional view taken along a line B—B in FIG. 4.
Figure 6:
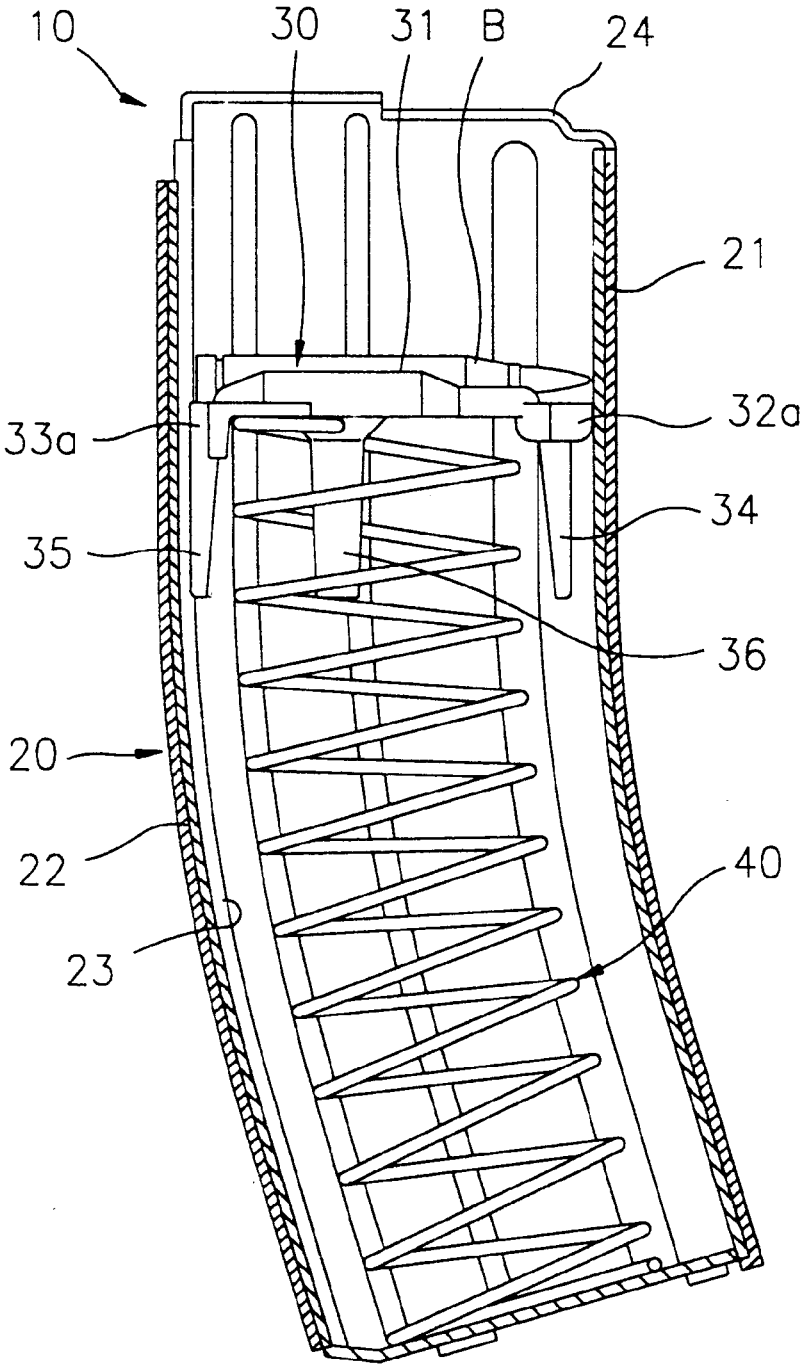
FIG. 6 is a cross-sectional side view showing a normal function of the cartridge magazine for a firearm according to the present invention.

As shown in FIG. 4, a cartridge magazine 10 for a firearm in accordance with the present invention includes: a case 20 for receiving bullets and having an open top and closed bottom thereof; a follower 30 inserted in the case 20 to move up and down therein; and a spring 40 for elastically and upwardly supporting the follower 30.

The case 20 is formed to have a top portion thereof open and a bottom thereof closed, wherein each of the side plates and the bottom plate is formed by a plating process such as a spot welding. A front wall 21 of the case 20 is formed to be horizontally flat. Along the center line of a rear wall 22 there is formed a guiding depression 23. Reference numeral 24 denotes an opening formed at a top of the case 20.

The follower 30 includes: a bullet support 31 which length and width correspond to those of a horizontally cross-sectioned internal region of the case 20, wherein in a front portion 32 thereof there are formed a pair of extrusions 32*a* each abutting the front wall 21 and in a rear portion 33 thereof there is formed a guiding extrusion 33*a* insertingly guided along the guiding depression 23; a balance protrusion 34 extending from a front lower surface of the bullet support 31 which lower surface is spaced from the front wall 21 by a certain distance; a guiding pin 35 extending downwardly from the guiding extrusion 33*a* and inserted in the depression 23 of the case 20 so as to be guided therein within the full extent of the depression 23; and an extrusion 36 extending downwardly from a backwardly eccentric center of the lower surface of the bullet support 31 for thereby fixing thereto the spring 40.

The rear portion 33 of the follower 30 is contacted to the rear wall 22 of the case 20. In an upper surface of the extrusion 36 for fixing the spring 40 there is provided a recess 36*a* formed by being punched from the front surface of the bullet support 31, into which recess 36*a* is inserted a static pin 41 bent extending from an upper portion of the spring 40, so that the detachment of the follower 30 and the spring 40 from the case 20 can be prevented.

The length of each of the balance protrusion 34 and the guiding pin 35 is formed to be similar to that of the extrusion 36 which fixed thereto the spring 40.

In such a cartridge magazine for a firearm according to present invention, when not loaded with any of the bullets the follower 30 remains pushed up by the spring 40 in order to be maintained in an upper portion of the opening 24 of the case 20.

Then, when a bullet B is pushed onto the bullet support 31 positioned in the opening 24, the follower 30 is downwardly pushed against the power of the spring 40 in order for the bullet B to be inserted into the case 20 through the opening 24. At this time, the inserted bullet B receives the elastic power via the follower 30. As a result, the bullet B remains inserted in the bullet cartridge because the opening 24 does not allow any of the bullets therein to be detached therefrom.

During a continuous loading of bullets into the case 20, the bullets are sequentially arranged in zigzag while maintaining a horizontal level of the bullets B in the space of the case 20.

As the loading continues, the follower 30 moves downwardly, and the pair of the extrusions 32*a* of the follower 30 are each contacted to and guided along the front wall 21 of the case 20. Also, the extrusion 33*a* formed in the rear portion 33 of the follower 30 is guided along the depression 23 formed in the rear wall 22 of the case 20 and at the same time the guiding pin 35 extended from the extrusion 33*a* of the rear portion 33 is guided along the depression 23 and balanced by the balance protrusion 34 extended from the lower surface of the front portion of the bullet support 30, whereby the follower 30 moves while maintaining a horizontal level of the bullet support 31.

Therefore, the bullet support 31 of the follower member 30 constantly maintains its horizontal level and the bullets B mounted sequentially thereon cause the front or rear portion of the bullets not to be exposed above the opening 24 but to be horizontal so that the sending of the bullet into the powder chamber of the firearm is easily carried out, thereby preventing a malfunction such as an unsending, double sending and unreceiving of bullets.

The present invention enables a cartridge magazine to be accurately loaded with a bullet or bullets to prevent an unsending, a double sending and/or unreceiving of the bullet or bullets to thereby decrease unwanted damage on bullets or internal parts of the firearm. Also, a psychological disorder of combat forces caused by a malfunctioning of a firearm will be released.

The advantage of the present invention is significant especially to a crooked cartridge magazine, wherein the lower part of the cartridge magazine is forward bent.

The present invention is not limited to the preferred embodiment but subject to variation with the scope thereof, wherein when a guiding depression is formed in a front wall other than a rear wall a substitute extrusion can be formed extending from a lower surface of a front portion of each of a pair of extrusions, and also when there is formed a guiding stripe other than in the front or rear portion of the bullet case, a guiding depression guided to extensions of the extrusions by the guiding strip can be formed lengthwise.

What is claimed is:

1. In a cartridge magazine for a firearm, the magazine comprising a case having an upper portion, a lower portion, a front wall and a rear wall, with an opening being formed at the upper portion, a closed plate being formed at the lower portion, and a first guiding means extending downwardly along one of the front and rear wall, wherein the first guiding means includes a depression formed along one of the front and rear walls, a follower provided inside the case therein and to be vertically movable, said follower further comprising a bullet support member, a guiding pin formed downwardly on one of a front and rear portion of the follower to be inserted and movable along the first guiding means, a balance protrusion formed downwardly on the follower and on an opposite side of the guiding pin, an extrusion formed on a bottom of the follower and between the balanced protrusion and the guiding pin for thereby fixing to a spring that elastically and constantly supports the follower, and the improvement wherein the balance protrusion, the extrusion, and the guiding pin are similar in length, structure, and configuration, the balance protrusion and guiding pin are of such a length that they abut against the front and rear walls, respectively, and do not engage the spring to maintain the follower in a predetermined horizontal position and to prevent tilting of the follower within said case when the follower moves vertically.

2. A cartridge magazine as recited in claim 1, wherein said case has a curved shape.

3. A cartridge magazine as recited in claim 1, wherein said cartridge magazine is configured for use in one of a rifle, a machine gun, or a submachine gun.

4. A cartridge magazine for a firearm, comprising:

a case having an upper portion, a lower portion, a front wall and a rear wall, with an opening being formed at the upper portion, a closed plate being formed at the lower portion, and a first guiding means extending downwardly along one of the front and rear walls, wherein the first guiding means includes a depression formed along one of the front and rear walls;

a follower provided inside the case, said follower configured to be vertically movable, said follower comprising a bullet support member, a guiding pin formed downwardly on one of a front and rear portion of the follower to be inserted in and movable along the first guiding means, a balance protrusion formed downwardly on the follower and on an opposite side of the guiding pin, an extrusion formed on a bottom of the follower and between the balance protrusion and the guiding in for thereby fixing to a spring that elastically and constantly supports the follower, wherein the balance protrusion, the extrusion and the guiding pin are similar in length, structure, and configuration, the balance protrusion and guiding pin are of such length that they abut against the front and rear walls, respectively, and do not engage the spring to maintain the follower in a predetermined horizontal position and to prevent tilting of the follower within said case when the follower moves vertically.

5. The cartridge magazine as recited in claim 4, wherein said case has a curved shape.

6. The cartridge magazine as recited in claim 4, wherein said cartridge magazine is configured for use in one of a rifle, a submachine gun, or a machine gun.

* * * * *